US009120666B2

(12) United States Patent
Purdy et al.

(10) Patent No.: US 9,120,666 B2
(45) Date of Patent: Sep. 1, 2015

(54) METHOD AND SYSTEM OF CHANGING FLOW CHARACTERISTICS OF A SUPPORT

(76) Inventors: William Purdy, White Plains, NY (US); Robert Purdy, Bedford, NY (US)

( * ) Notice: Subject to any disclaimer, the term of this patent is extended or adjusted under 35 U.S.C. 154(b) by 0 days.

(21) Appl. No.: 13/493,478

(22) Filed: Jun. 11, 2012

(65) Prior Publication Data

US 2012/0311787 A1 Dec. 13, 2012

Related U.S. Application Data

(60) Provisional application No. 61/495,078, filed on Jun. 9, 2011.

(51) Int. Cl.

| | |
|---|---|
| ***B68G 1/00*** | (2006.01) |
| ***A47C 20/00*** | (2006.01) |
| *A61G 7/057* | (2006.01) |

(52) U.S. Cl.

CPC . *B68G 1/00* (2013.01); *A47C 20/00* (2013.01); *A61G 7/05753* (2013.01)

(58) Field of Classification Search

CPC ..... A47G 9/10; A47G 9/1027; A47C 27/00; A47C 27/10; A47C 20/021; A47C 20/023; A61G 7/05769; A61G 13/1235; A61G 13/121; A61G 13/1255

USPC ..... 5/644, 646, 713, 630, 648, 676, 654, 5/655.4; 73/38, 37; 2/455; 428/325, 327, 428/373; 106/122

See application file for complete search history.

(56) References Cited

U.S. PATENT DOCUMENTS

| | | | | |
|---|---|---|---|---|
| 3,764,404 | A * | 10/1973 | Van Thyne | 148/317 |
| 5,079,786 | A * | 1/1992 | Rojas | 5/654 |
| 5,549,743 | A * | 8/1996 | Pearce | 106/122 |
| 5,680,662 | A * | 10/1997 | Purdy et al. | 5/676 |
| 6,453,477 | B1 * | 9/2002 | Bainbridge et al. | 2/455 |
| 6,672,548 | B1 * | 1/2004 | Yates | 248/118 |
| 6,986,170 | B2 * | 1/2006 | Nelson | 2/455 |
| 7,754,791 | B2 * | 7/2010 | Sereboff | 524/27 |
| 7,966,680 | B2 * | 6/2011 | Romano et al. | 5/713 |
| 8,171,585 | B2 * | 5/2012 | Mead et al. | 5/655.4 |
| 2007/0105970 | A1 * | 5/2007 | Warnshuis et al. | 521/56 |
| 2007/0163571 | A1 * | 7/2007 | Sereboff | 126/599 |

* cited by examiner

*Primary Examiner* — Peter M Cuomo
*Assistant Examiner* — Brittany Wilson
(74) *Attorney, Agent, or Firm* — Porzio, Bromberg & Newman, P.C.

(57) ABSTRACT

The present invention provides a method and system for customization of flow characteristics of a support using permanent and controlled evacuation of interstitial gas during the manufacturing process. The flow characteristics can be customized to provide a stiffer or less stiff support by a comparative degree. The flow characteristics can be permanently changed. The support includes a bladder filled with a fluidized particulate material. The medium of the fluidized particulate material includes interstitial spaces. A predetermined amount of gas can be removed to provide a support having a desired specific support characteristic.

23 Claims, 9 Drawing Sheets

METHOD AND SYSTEM OF CHANGING FLOW CHARACTERISTICS OF A SUPPORT

CROSS REFERENCE TO RELATED APPLICATION

This application claims the benefit of U.S. Provisional Patent Application No. 61/495,078, filed Jun. 9, 2011, the entirety of which is hereby incorporated by reference into this application.

BACKGROUND OF THE INVENTION

Positioners, pressure relief devices, offloading devices and supports for body parts are known. For example, pillows or pads have been used for support of body parts. The supports have typically been formed of foam, gel or polyfill. Positioning aids have been described for restraining or immobilizing a part of the body of a medical patient. U.S. Pat. No. 3,764,404 describes a positioning aid. Polystyrene beads are confined within a bag. A self-closing valve communicating with the interior of the bag is used for evacuating air therefrom. After the bag is conformed to a portion of a patient's body, the positioning aid is evacuated and the aid becomes rigid with no flow characteristics of the material.

It is desirable to provide a support having no memory or substantially no memory to enable the support to maintain contour to a body part. It is also desirable to provide a method and system for changing flow characteristics of a support, such as body part support and in particular, to a custom fitting limb or body part support.

SUMMARY OF THE INVENTION

The present invention provides a method and system for customization of flow characteristics of a support using permanent and controlled evacuation of interstitial gas during the manufacturing process. For example, the gas can be air, helium, hydrogen or nitrogen. The flow characteristics can be customized to provide a stiffer or less stiff support by a comparative degree. For example, a bladder with reduced flow characteristics can be used in an operating room and a bladder with maximum flow characteristics could be used in an ICU. The flow characteristics can be permanently changed.

The support includes a bladder filled with a fluidized particulate material. The medium of the fluidized particulate material includes interstitial spaces. The interstitial spaces can be formed by separation of the particulate material which is determined by shapes and sizes of particulate material. In one embodiment, the interstitial gas that is removed can be from within beads of the fluidized particulate material. In one embodiment, the particulate material refers to a compound or composition which can be sculpted and retain its shape and has no memory or substantially no memory. The no memory or substantially no memory feature enables the bladder to increase in height and simultaneously maintain support and three-dimensional micro-contouring to a body part. As the deflation occurs, the flow characteristic of the particulate material is changed.

A predetermined amount of gas can be removed to provide a support having a specific support characteristic. The present invention provides that an amount of gas of about 500 millibars, preferably about 350 millibars to about 5 millibars to zero can be evacuated and the support will still provide fluid flow characteristics. In the present invention, a combination of a fill weight of the material within the support and the amount of gas removed can be used to control the flow characteristics of the material within the support. In one embodiment, substantially all gas is withdrawn from other fluidized particulate material, for example, to a pressure below about 5 millibars. In theory, flow characteristics can be brought below about 5 millibars but would render product non-functional because it would severely limit flow capabilities in most but not all particulate mediums.

The support can be used as a pillow or as a pad to support any body extremity. For example, the support can be sized to fit and conform around a limb, such as an arm or leg or a portion thereof, foot, heel, finger, toe, torso, occiput, face or neck.

The invention will be more fully described by reference to the following drawings.

DETAILED DESCRIPTION

Figure 1:
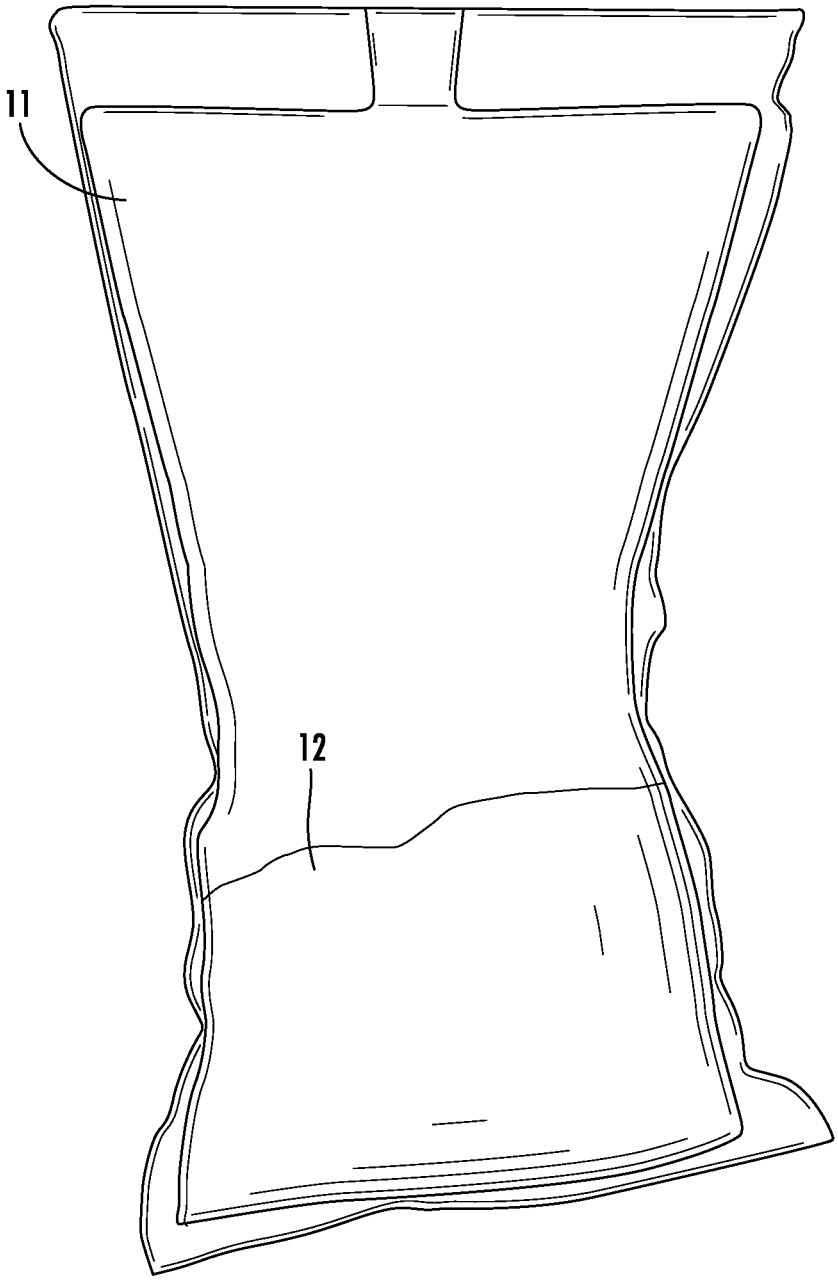
FIG. 1 is a schematic diagram of a bladder filled with a composition.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 illustrates a step in a method for changing flow characteristics of a support in accordance with the teachings of the present invention in which bladder 11 is filled with composition 12 which can retain its shape after sculpting which is controlled by evacuation of gas from composition 12. Composition 12 can be a particulate material including interstitial spaces between the particles. The amount of gas that is evacuated can depend on the size of the particles of the composition, wetness of the particles, dryness of the particles, amount of lubricant, hardness of the particle and the coefficient of the friction of the particles. Alternatively, composition 12 can include an encapsulated phase change material. For example, the phase change material can be encapsulated in a shell.

Figure 2:
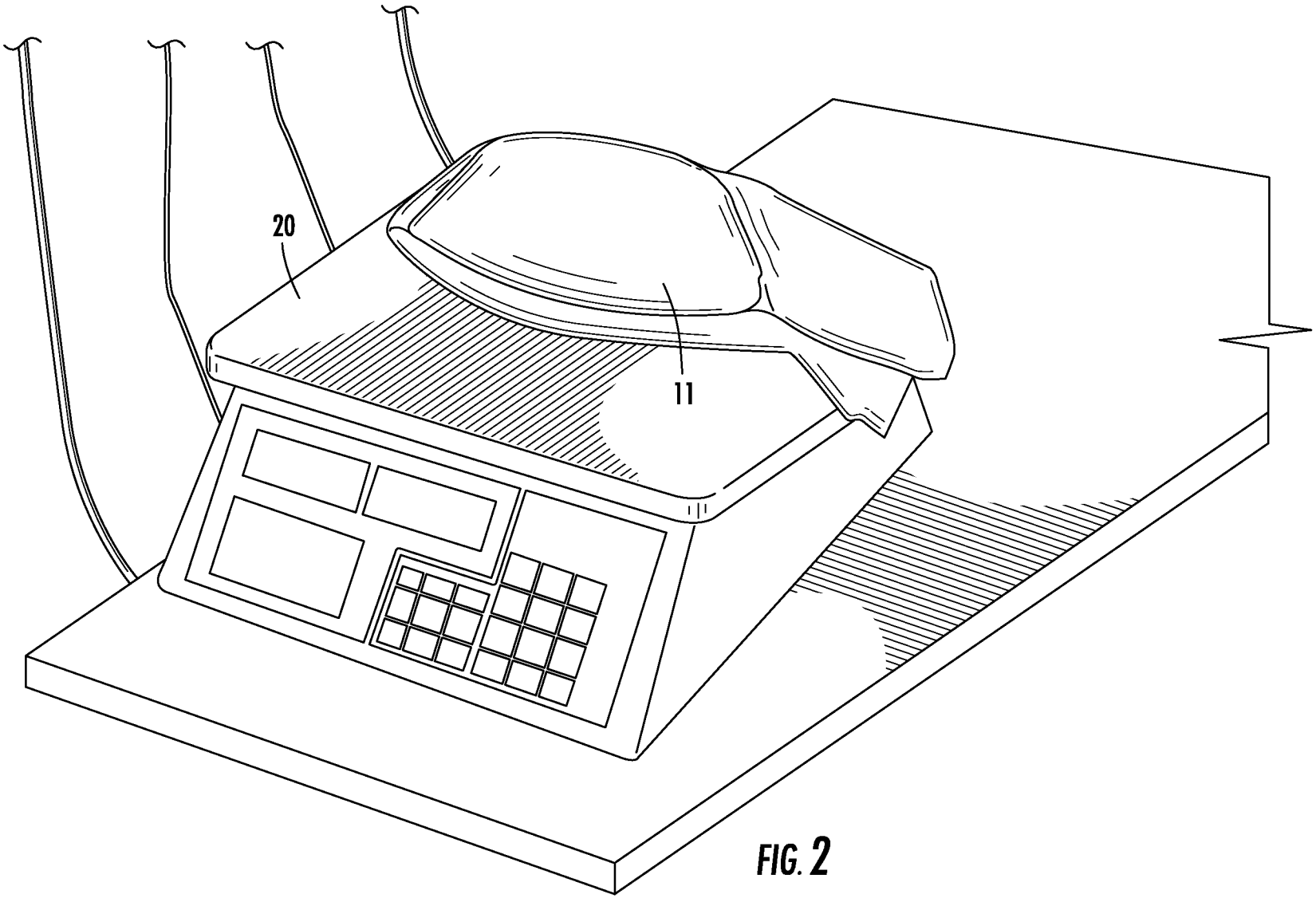
FIG. 2 is a schematic diagram of a bladder being weighed.
Figure 3:
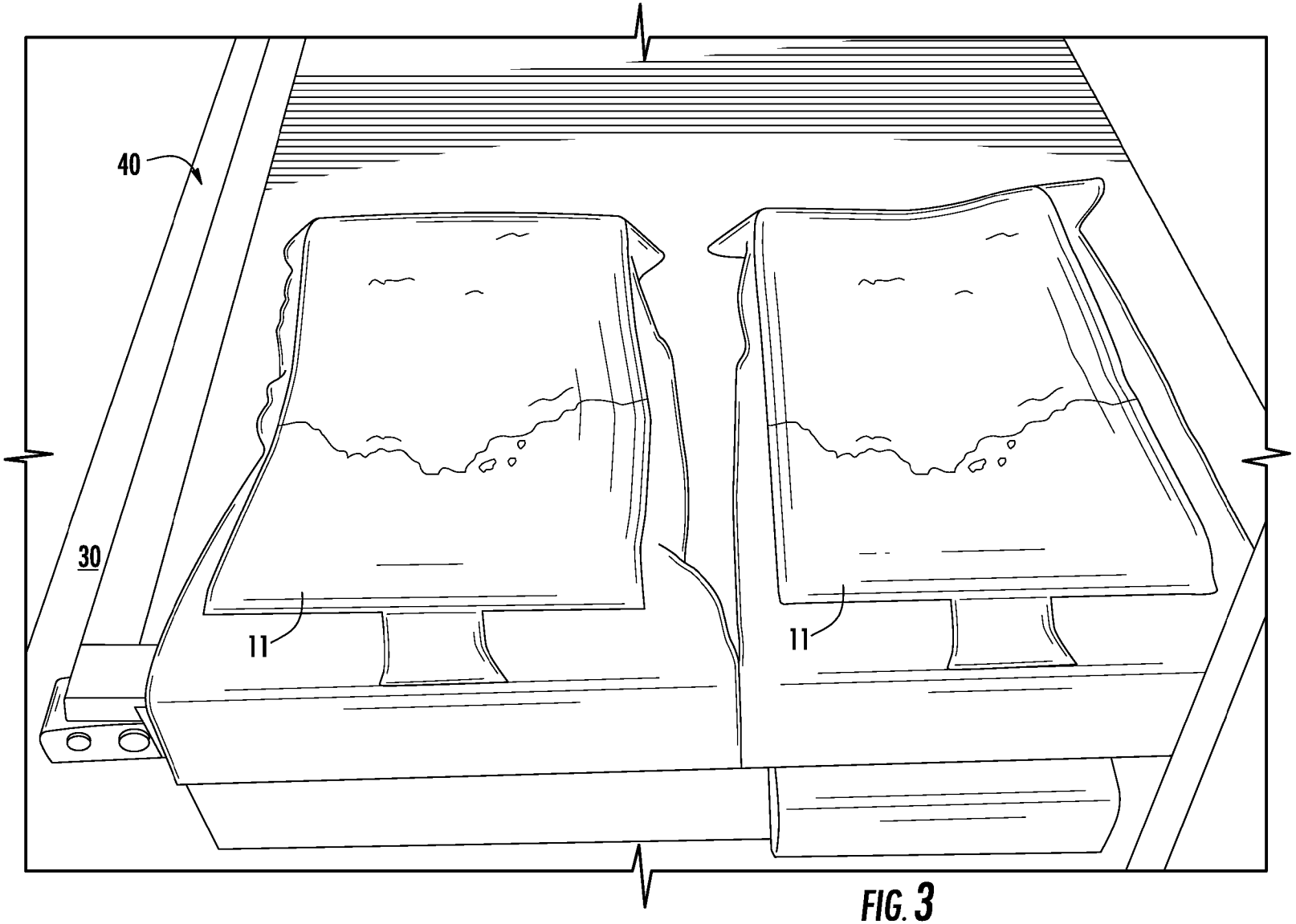
FIG. 3 is a schematic diagram of bladder placement on a vacuum and sealing machine.
Figure 4:
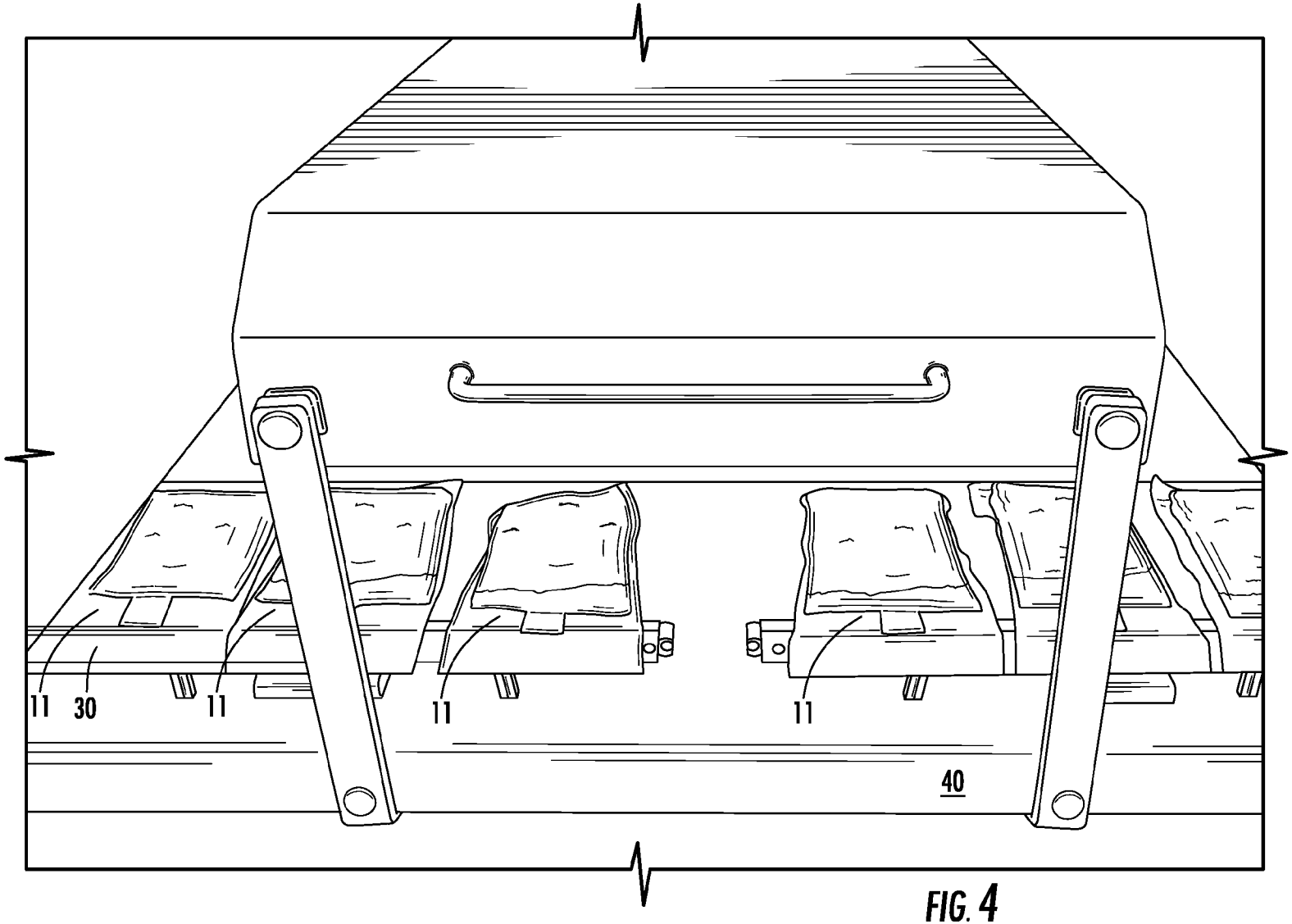
FIG. 4 is a schematic diagram of bladders on a vacuum and sealing machine.

In a subsequent step, bladder 11 is weighed on scale 20, as shown in FIG. 2. In a subsequent step, bladder 11 is placed on conveyor 30 of vacuum and sealing machine 40, as shown in FIGS. 3 and 4. Vacuum and sealing machine 40 removes a predetermined amount gas from composition 12 for creating a predetermined flow characteristic to composition 12 within bladder 11. An example vacuum can sealing machine is manufactured by Multi-Vac machine that receives and puts pack in air at a desired level. For example, the gas can be air, helium, hydrogen or nitrogen. For example, if a greater amount of gas is removed, the composition will have a reduced flow characteristic. The amount of gas evacuated from the bladder determines permanent flow characteristics of the bladder. In a preferred embodiment, an amount of gas of about 500 millibars to about 5 millibars, preferably about 350 millibars to about 5 millibars or to zero millibars can be evacuated and the support will still provide fluid particulate flow characteristics.

Figure 5:
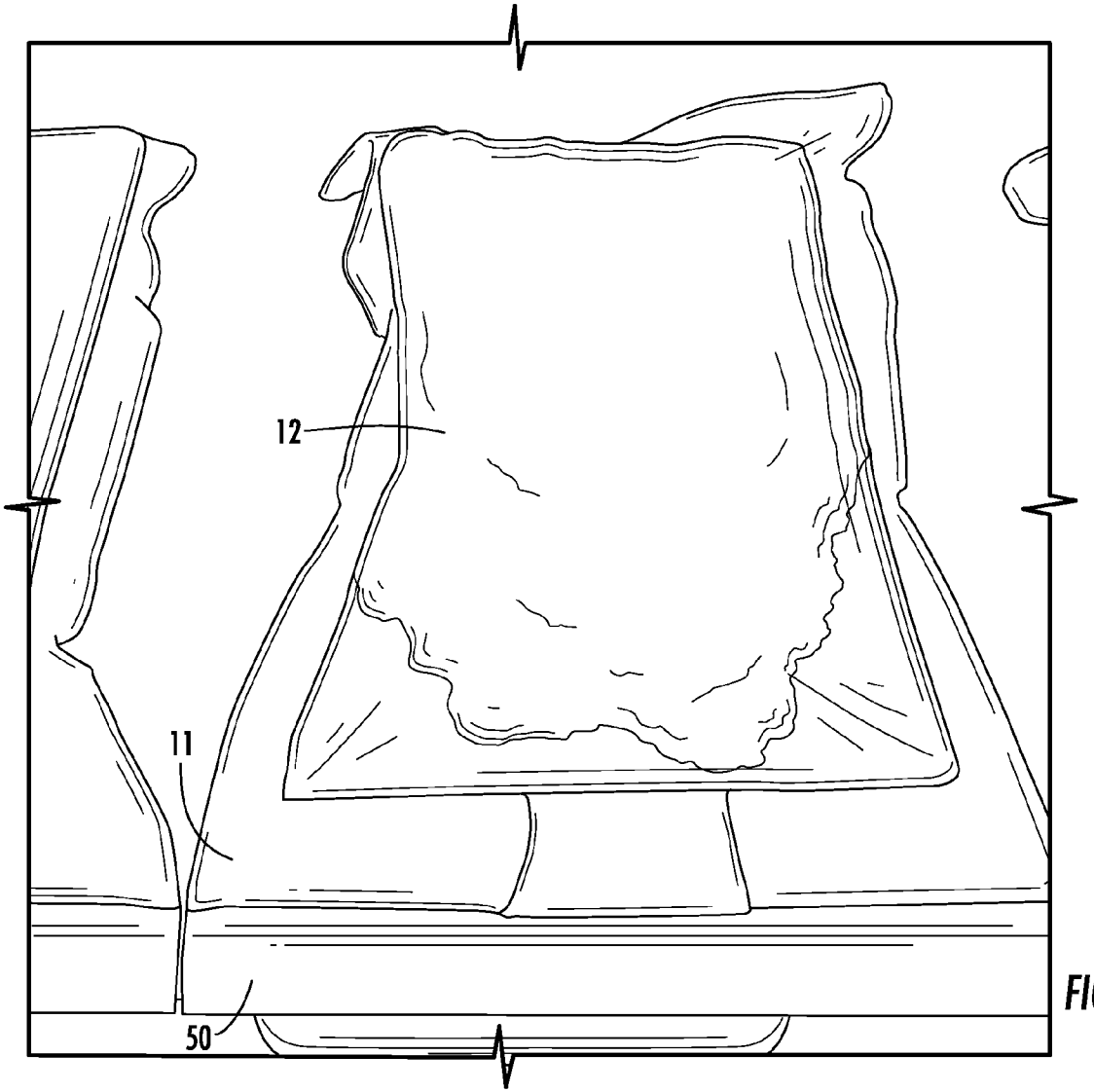
FIG. 5 is a schematic diagram of the bladder after removing air.
Figure 6:
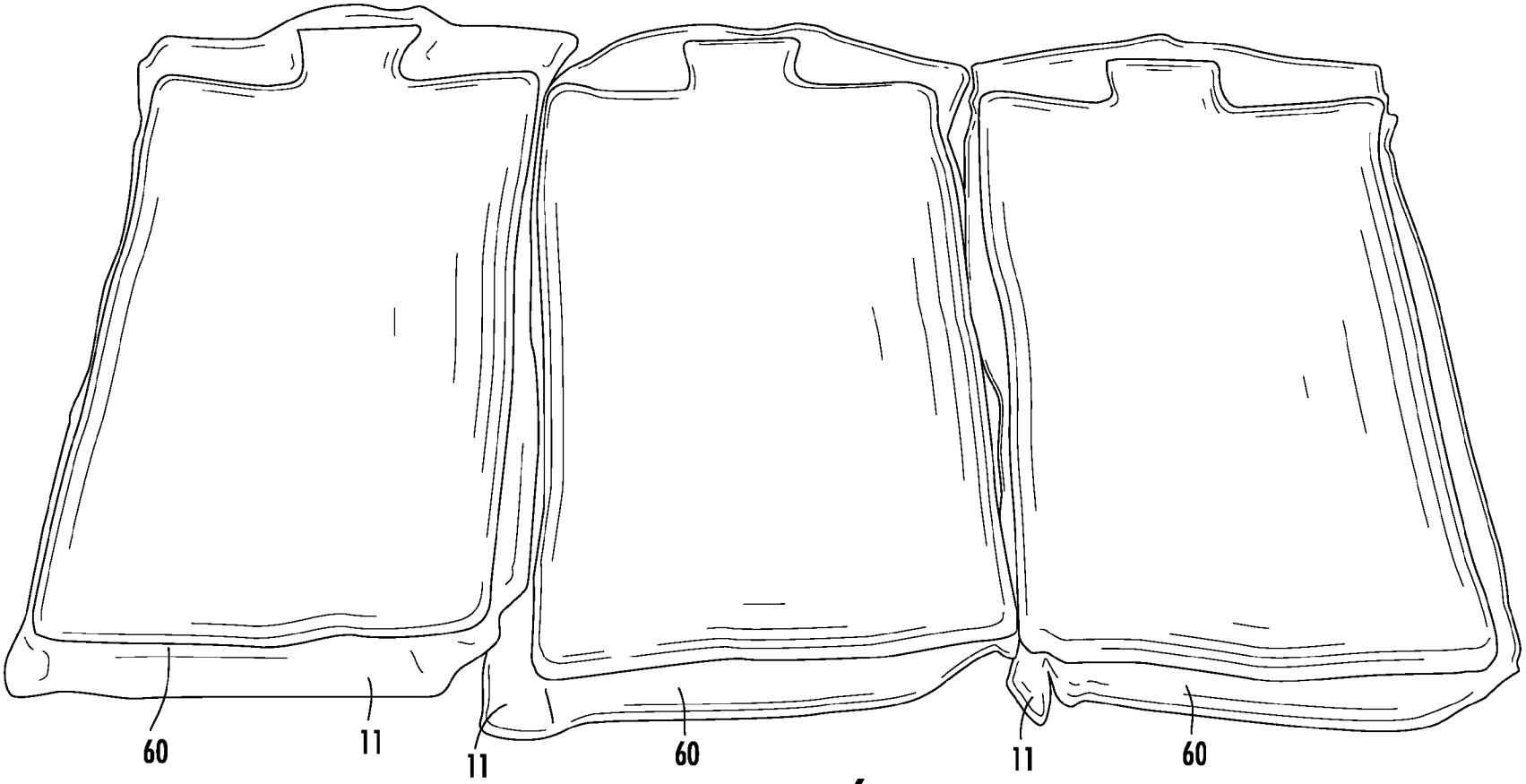
FIG. 6 is a schematic diagram of a bladder after smoothing and trimming.

FIG. 5 illustrates bladder 11 after bladder 11 has been sealed and vacuumed before excess trim 50 is removed from bladder 11. Bladder 11 has a wrinkled appearance indicating that gas has been removed and composition 12 within bladder 11 has predetermined permanent flow characteristics. FIG. 6 illustrates support 60 comprising bladder 11 which has been trimmed to remove trim. Bladder 11 is smoothed to level composition 12 within bladder 11 and to check for leaks in seals of bladder 11. Bladder 11 moves with composition 12 during contouring of bladder 11.

Support 60 is formed to have a predetermined permanent flow characteristic. Support 60 can be formed to fit around any body extremity. For example, support 60 can be sized to fit around a limb, such as an arm or leg or a portion thereof, finger, toe, torso, occiput, face or neck for providing simultaneous support characteristics and three-dimensional contouring characteristics.

Figure 7A:
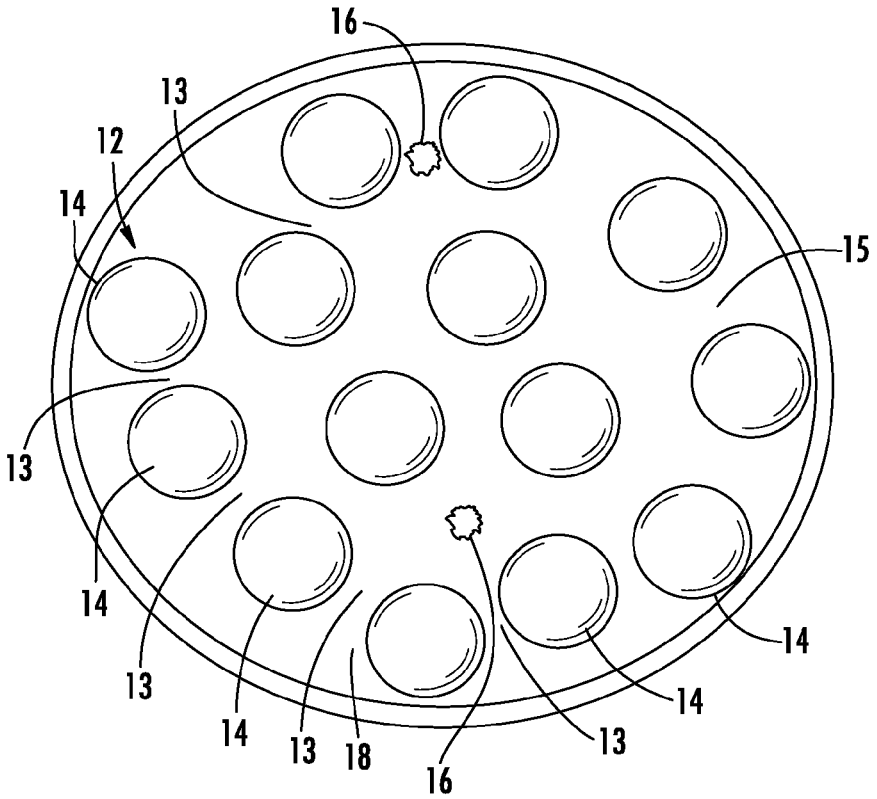
FIG. 7A is a schematic diagram of the composition of the present invention including interstitial spacing.
Figure 7B:
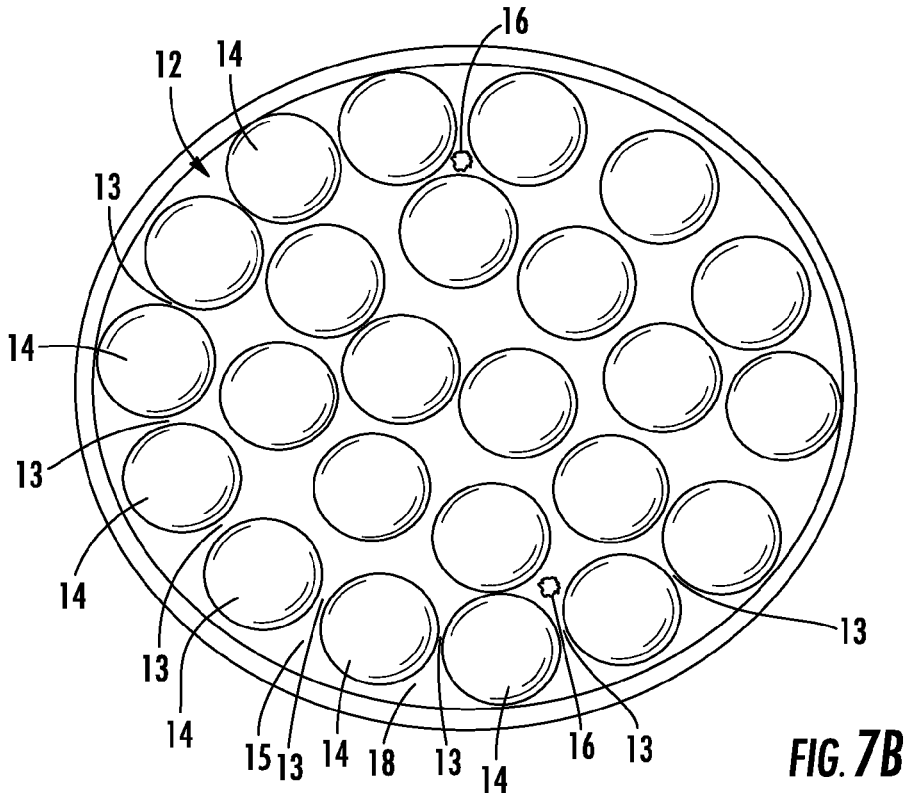
FIG. 7B is a schematic diagram of the composition of the present invention including interstitial spacing which is less than the interstitial spacing shown in FIG. 7A.
Figure 7C:
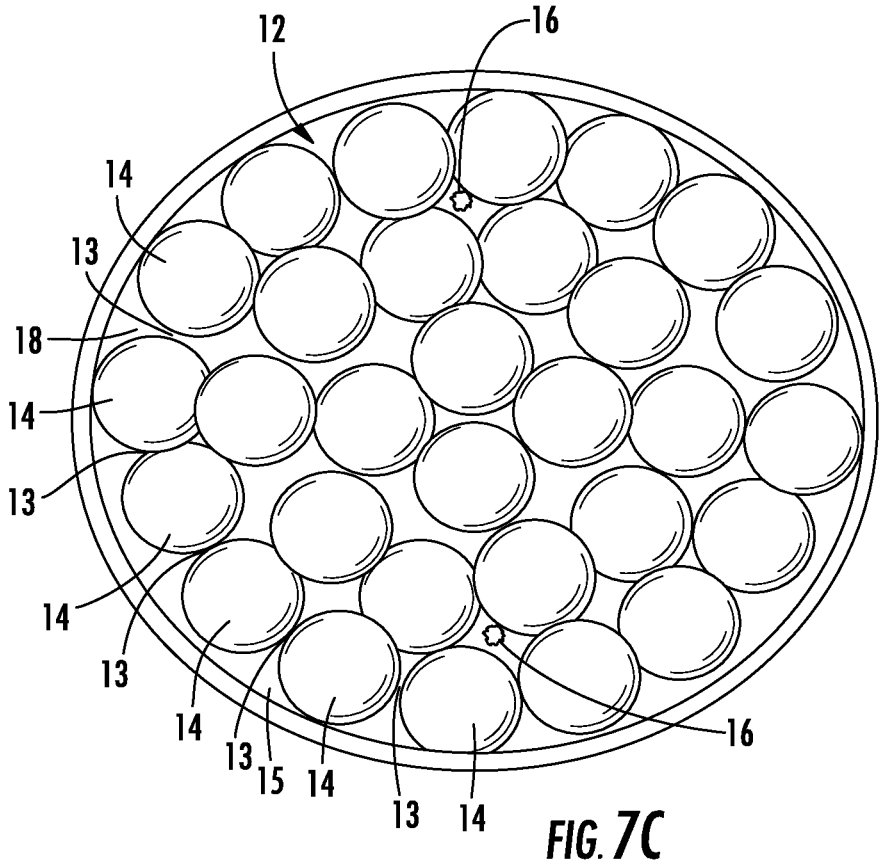
FIG. 7C is a schematic diagram of the composition of the present invention including interstitial spacing which is less than the interstitial spacing shown in FIG. 7B.

FIGS. 7A-7C illustrate composition 12 including particles 14 and interstitial spacing 13. Gas 15 can be present in spacing 13. For example, gas 15 can be air, helium, hydrogen, or nitrogen. FIG. 7A illustrates composition 12 having greater interstitial spacing 13 than shown in FIG. 7B. FIG. 7B illustrates composition 12 having greater interstitial spacing 13 than shown in FIG. 7C. Accordingly, composition 12 shown in FIG. 7A will have the greatest flow characteristics and composition 12 shown in FIG. 7C will have the least flow characteristics. It will be appreciated that that in an alternative embodiment, composition 12 can be a porous foam substance including pockets of interstitial gas. In one embodiment, composition 12 can be a polyurethane foam. The polyurethane foam can be open or closed cell and cut into small shapes such as spheres or blocks. For example, a sphere of polyurethane foam can have a size of 2 inches in diameter. For example, a block of polyurethane foam can be a 1×1×1 inch block.

In one embodiment, composition 12 can include a compound or composition which can be sculpted and retain its shape and has no memory or substantially no memory. The no memory or substantially no memory feature enables bladder 11 to mold in order to increase in height and maintain support of a body part. Composition 12 can be made of a viscosity that will allow it to contour but not collapse under the weight of the body part. In one embodiment, composition 12 can be formed of a mixture of microspheres and lubricant. The microspheres can include hollow or gas-filled structural bubbles (typically of glass or plastic) with an average diameter of less than 200 microns. The composition flows and stresses in response to a deforming pressure exerted on it and the composition ceases to flow and stresses when the deforming pressure is terminated. For example, composition 12 can be formed of a product referenced to as Floam™. A flowable compound comprising lubricated microspheres, including the compound itself, formulations for making the compound, methods for making the compound, products made from the compound and methods for making products from the compound as defined by U.S. Pat. Nos. 5,421,874, 5,549,743, 5,626,657, 6,020,055, 6,197,099, and 8,171,585, each of which is hereby incorporated by reference into this application.

Bladder 11 can be formed of any air tight flexible plastic, such as urethane. Upon removal of residual gas 15 from composition 12, bladder 11 flows concurrent with the flow of composition 12 such that bladder 11 moves with movement of composition 12. Bladder 11 provides micro-contouring because composition 12 can respond three-dimensionally.

In one embodiment, thermo-regulating material 16 is associated with composition 12. An example material for thermo-regulating material 16 is manufactured by Outlast Technologies as fibers, fabrics, and foams comprising micro-encapsulated phase changing materials referred to as Thermocules, which store and release heat as further described in U.S. Pat. Nos. 7,790,283, 7,666,502 and 7,579,078, hereby incorporated by reference into this application. In one embodiment, the phase change material is a particulate or a lubricant for a particulate.

In one embodiment, a lubricant and/or binding agent 18 can be present in interstitial spaces 13. For example, lubricant and/or binding agent 18 can be a particulate material having a lower coefficient of friction, such as a powder. Lubricant and/or binding agent 18 can also include a dry medium, moist medium or wet medium. In one embodiment, composition 12 can include beads, such as polyethylene or polystyrene beads, expanded cross linked polyethylene, polypropylene beads, foam beads, or beads made of a similar medium. The beads can be hard shelled or flexible. In one embodiment, the beads are porous and flexible and gas 15 can be evacuated from the beads. In one embodiment, hard or rigid beads can be mixed with flexible beads in which gas 15 can be evacuated from the flexible beads. In one embodiment, composition 12 includes closed cell beads and open cell beads, such as foam, and gas 15 is removed from the foam. The smaller the interstitial spaces, the more the particles will collide thereby making composition 12 stiffer.

The fluidized particulate material forming composition 12 can be formed of a material that normally would not have fluid characteristics in which flow characteristics are provided based on the interstitial spaces formed within the fluidized particulate material. A fluidized particulate material can be formed by lubricating spherical particles, using powder spherical particles and/or reducing the coefficient of friction. The flow characteristics can be controlled, for example, by reducing interstitial gas 15 which reduces the flow of the fluidized particulate material reducing surface contact which reduces friction between particles of the fluidized particulate material and/or using hard and soft particles in the fluidized particulate material.

In one embodiment, substantially all gas is withdrawn from the fluidized particulate material, for example, to a pressure below about 5 millibars.

The shapes and sizes of the particles in composition 12 can be selected to achieve desired flow characteristics. In one embodiment, a larger particulate material, such as expandable polyethylene beads, is used in composition 12 to provide greater interstitial spaces between particles. In this embodiment, increased gas is evacuated in order to achieve similar flow characteristics for composition 12, including smaller particles. The reduction of interstitial space by virtue of the addition of wet or dry lubricant will change the amount of air evacuation required to reduce the flow characteristic.

In one embodiment, lubricant is formed as an emulsification of porous beads that partially fills interstitial spaces. In this embodiment, less gas is withdrawn from the interstitial spaces 13 due to the porosity of the porous beads.

Figure 8:
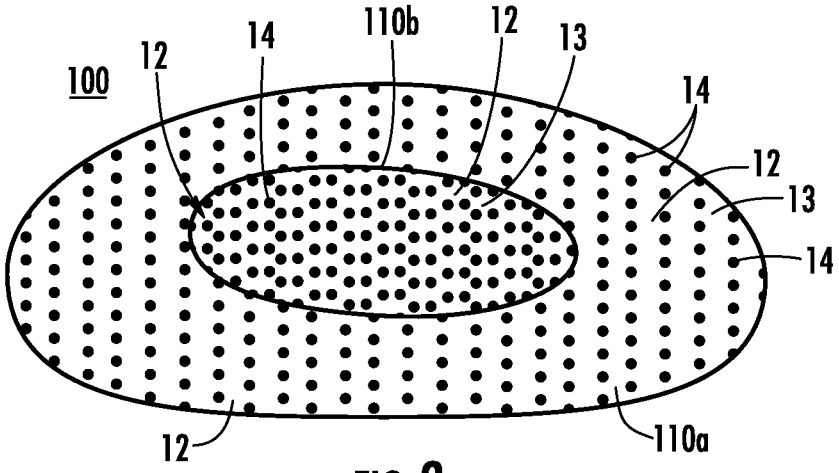
FIG. 8 is a schematic diagram of a system including a plurality of bladders filled with the composition with each of the layers including a predetermined permanent flow characteristic.

FIG. 8 illustrates an alternate embodiment including support 100 formed of a plurality of bladders 110*a*-110*b*. Each of bladders 110*a*-110*b* is filled with composition 12 which can retain its shape after sculpting which is controlled by evacuation of gas from composition 12. Composition 12 can be a particulate material including interstitial spaces 13 between particles 14. An amount of gas can be evacuated independently in each of bladders 110*a*-110*b* to provide each of bladders 110*a*-110*b* with a desired predetermined flow characteristic. The amount of gas that is evacuated can depend on the size of the particles of the composition, wetness of the particles, dryness of the particles, amount of lubricant, hardness of the particle and the coefficient of the friction of the particles. In one embodiment, a different composition 12 is used in one or more of bladders 110*a*-110*b*.

Support 100 is formed to have predetermined permanent flow characteristics. In this embodiment, bladder 110*a* provides increased flow characteristics over bladder 110*b* which has reduced flow characteristics. Accordingly, bladder 110*a* provides less support than bladder 110*b*. Composition 12 having greater interstitial spacing 13 is shown in bladder 110*a*. Composition 12 having less interstitial spacing 13 is shown in bladder 110*b*. Accordingly, composition 12 shown in bladder 110*a* will have the greatest flow characteristics and composition 12 shown in bladder 110*b* will have the least flow characteristics. For example, an amount of gas can be evacuated from bladder 110*a* to provide a pressure in the range of about 500 millibars to about 100 millibars. An amount of gas can be evacuated from bladder 110*b* to provide a pressure in the range of about 100 millibars to about 5 millibars.

Figure 9:
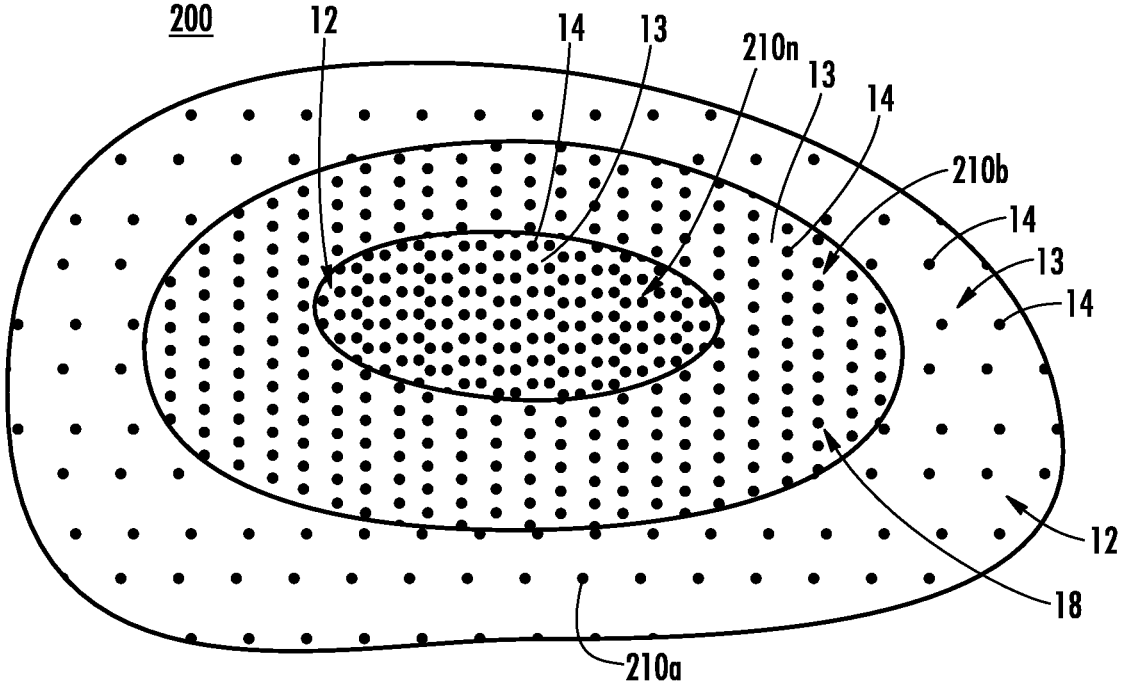
FIG. 9 is a schematic diagram of a system including a plurality of bladders filled with the composition with each of the layers including a predetermined permanent flow characteristic.

FIG. 9 illustrates an alternate embodiment including support 200 formed of a plurality of bladders 210*a*-210*n*. Each of bladders 210*a*-210*n* is filled with composition 12 which can retain its shape after sculpting which is controlled by evacuation of gas from composition 12. Composition 12 can be a particulate material including interstitial spaces 13 between particles 14. An amount of gas can be evacuated independently in each of bladders 210*a*-210*n* to provide each of bladders 210*a*-210*n* with a desired predetermined flow characteristic. The amount of gas that is evacuated can depend on the size of the particles of the composition, wetness of the particles, dryness of the particles, amount of lubricant, hardness of the particle and the coefficient of the friction of the particles. In one embodiment, a different composition 12 is used in one or more of bladders 210*a*-210*n*.

Support 200 is formed to have predetermined permanent flow characteristics. In this embodiment, bladder 210*a* provides increased flow characteristics over bladder 210*b*. Bladder 210*b* has increased flow characteristics over bladder 210*n*. Accordingly, bladder 210*a* provides minimum or loose support. Bladder 210*b* provides medium support. Bladder 210*c* provides maximum or stiff support. Composition 12 having the greatest interstitial spacing 13 is shown in bladder 210*a*. Composition 12 having reduced interstitial spacing 13 is shown in bladder 210*b*. Composition 12 having the least interstitial spacing 13 is shown in bladder 210*n*. Accordingly, composition 12 shown in bladder 210*a* will have the greatest flow characteristics. Composition 12 shown in bladder 210*b* will have flow characteristics less than the flow characteristics in bladder 210*a* and more than the flow characteristics in bladder 210*n*. Composition 12 shown in bladder 210*n* will have the least flow characteristics. For example, an amount of gas can be evacuated from bladder 210*a* to provide a pressure in the range of about 500 millibars to about 100 millibars. An amount of gas can be evacuated from bladder 210*b* to provide a pressure in the range of about 100 millibars to about 25 millibars. An amount of gas can be evacuated from bladder 210*n* to provide a pressure in the range of about 25 millibars to about 5 millibars.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A method for determining a flow characteristic of a support comprising the step of:

(a) providing a support, said support comprising a bladder, said bladder including a fluidized particulate material including interstitial spaces between particles of said particulate material with said gas filling said interstitial spaces, (b) evacuating said gas filling said interstitial spaces by vacuum to a predetermined pressure; and (c) sealing said bladder after step (b), the predetermined pressure is maintained permanently within the support to achieve a predetermined permanent flow characteristic within the support.

2. The method of claim 1 wherein said fluidized particulate material is a compound or composition which can be sculpted and retain its shape and has no memory or substantially no memory.

3. The method of claim 2 further comprising a lubricant within said bladder.

4. The method of claim 3 wherein said lubricant comprises a powder.

5. The method of claim 3 wherein said lubricant comprises a dry medium, moist medium, or wet medium.

6. The method of claim 3 wherein said lubricant is an emulsification of the particulate material.

7. The method of claim 6 wherein the particulate material is porous beads.

8. The method of claim 1 wherein said fluidized particulate material comprises beads.

9. The method of claim 8 wherein said beads are selected from the group consisting of polyethylene beads, polystyrene beads, expanded cross linked polyethylene polypropylene beads and foam beads.

10. The method of claim 8 wherein said beads are flexible and gas is removed from said beads.

11. The method of claim 10 further comprising rigid beads.

12. The method of claim 8 wherein said beads are closed cell beads and open cell beads, wherein said gas is removed from said open cell beads.

13. The method of claim 12 wherein said open cell beads are foam beads.

14. The method of claim 1 further comprising a thermoregulating material associated with said fluidized particulate material.

15. The method of claim 1 wherein an amount of gas is evacuated to provide a pressure of about 500 millibars up to zero millibars is evacuated from said bladder.

16. The method of claim 1 wherein an amount of gas is evacuated to provide a pressure of about 350 millibars up to about 5 millibars in said bladder.

17. The method of claim 1 wherein said support comprises a plurality of said bladders and step (b) is repeated for evacuating said gas to a predetermined pressure in each of said bladders.

18. The method of claim 17 wherein said support comprises two of the bladders, wherein an amount of gas is evacuated to provide a pressure of about 500 millibars to about 100 millibars in one of the bladders and an amount of gas is evacuated to provide a pressure of about 100 millibars to about 5 millibars in the other one of the bladders.

19. The method of claim 17 wherein an amount of gas is evacuated to provide a pressure of about 500 millibars to about 100 millibars in a first one of the bladders wherein amount of gas is evacuated to provide a pressure of about 100 millibars to about 25 millibars in a second one of the bladders and wherein amount of gas is evacuated to provide a pressure of about 25 millibars to about 5 millibars in a third one of the bladders.

20. A support for a body part formed by the method of claim 17.

21. The support of claim 20 wherein said support is adapted to support the body part of a limb, finger, toe, torso, occiput, face or neck.

22. A support for a body part formed by the method of claim 1.

23. The support of claim 22 wherein said support is adapted to support the body part of a limb, finger, toe, torso, occiput, face or neck.

* * * * *